US005709265A

United States Patent [19]

Haugen et al.

[11] Patent Number: 5,709,265

[45] Date of Patent: Jan. 20, 1998

[54] WELLBORE WINDOW FORMATION

[75] Inventors: David M. Haugen, League City; Guy L McClung, III, Spring, both of Tex.

[73] Assignee: Weatherford/Lamb, Inc., Houston, Tex.

[21] Appl. No.: 688,301

[22] Filed: Jul. 30, 1996

Related U.S. Application Data

[63] Continuation-in-part of Ser. No. 568,878, Dec. 11, 1995, Pat. No. 5,636,692.

[51] Int. Cl.[6] ..... E21B 43/116

[52] U.S. Cl. ..... 166/55.2; 166/55.6; 166/117.6

[58] Field of Search ..... 166/117.6, 123, 166/297, 298, 382, 55.2, 55.6

[56] References Cited

U.S. PATENT DOCUMENTS

| | | | |
|---|---|---|---|
| 941,852 | 11/1909 | Broadwater . | |
| 1,641,483 | 9/1927 | Greene . | |
| 2,067,408 | 1/1937 | Morris | 166/63 |
| 2,080,875 | 5/1937 | Pitzer | 166/299 |
| 2,141,827 | 12/1938 | Schlumberger | 102/1 |
| 2,214,226 | 9/1940 | English . | |
| 2,302,567 | 11/1942 | O'Neill | 166/1 |
| 2,315,496 | 4/1943 | Boynton | 166/1 |
| 2,519,116 | 8/1950 | Crake | 411/20 |
| 2,535,964 | 12/1950 | Stanton . | |
| 2,587,244 | 2/1952 | Sweetman . | |
| 2,621,351 | 12/1952 | Piety | 15/104.05 |
| 2,629,445 | 2/1953 | Dill | 166/55 X |
| 2,679,380 | 5/1954 | Sweetman . | |
| 2,680,487 | 6/1954 | Carpenter | 166/1 |
| 2,703,053 | 3/1955 | Castel | 102/20 |
| 2,758,543 | 8/1956 | Grandin . | |
| 2,858,653 | 11/1958 | Guptill, Jr. | 51/282 |
| 2,897,756 | 8/1959 | Borins et al. | 102/21 |
| 2,918,125 | 12/1959 | Sweetman | 166/55 X |
| 3,014,423 | 12/1961 | Robinson, Jr. et al. | 102/20 |
| 3,053,182 | 9/1962 | Christopher . | |
| 3,066,735 | 12/1962 | Zingg | 166/55 |
| 3,066,736 | 12/1962 | Venghiattis | 166/55.1 |
| 3,070,011 | 12/1962 | Robinson, Jr. et al. . | |
| 3,076,507 | 2/1963 | Sweetman | 166/55 X |
| 3,118,508 | 1/1964 | Friedman et al. . | |
| 3,138,207 | 6/1964 | Peppers | 166/63 |
| 3,175,617 | 3/1965 | North | 166/55.1 |
| 3,273,642 | 9/1966 | Karpovich | 166/299 |
| 3,318,395 | 5/1967 | Messmer | 175/14 |
| 3,404,919 | 10/1968 | Dixon | 299/13 |
| 3,576,219 | 4/1971 | Angona | 175/4.5 |
| 3,654,866 | 4/1972 | Fritz | 102/312 |
| 3,874,461 | 4/1975 | Cocanower | 175/4.6 |
| 3,878,786 | 4/1975 | Ridgeway | 102/27 R |
| 3,951,218 | 4/1976 | Sjogren | 175/4.6 |
| 3,965,993 | 6/1976 | LaVigne et al. | 175/4.6 |
| 3,990,507 | 11/1976 | Vann | 166/55.1 |
| 3,990,512 | 11/1976 | Kuris | 166/299 |

(List continued on next page.)

FOREIGN PATENT DOCUMENTS

95/302209.2 3/1995 European Pat. Off. .

OTHER PUBLICATIONS

"Seminar on Oilfield Explosives," Ensign–Bickford Co., 1995.

"Recommended Practices For Oilfield Explosives Safety," American Petroleum Institute, 1994.

"Perforating Technology For the 21st Century," Hart's Pertoleum Engineer Int'l, Sep. 1996, pp. 61–81.

U.S. Patents Official Gazette entry for U.S. 5,603,379. 18 Feb. 1997.

"Procedures for Running Explosives For Wellhead Severance," A–1 Homco, pp. 1–32, 1993.

*Primary Examiner*—Frank Tsay
*Attorney, Agent, or Firm*—Guy McClung

[57] ABSTRACT

New systems and methods have been invented for explosively forming openings, ledges, windows, holes, and lateral bores through tubulars such as casing, which openings may, in cerain aspects, extend beyond the casing into a formation through which a wellbore extends.

20 Claims, 14 Drawing Sheets

U.S. PATENT DOCUMENTS

| | | | |
|---|---|---|---|
| 4,071,096 | 1/1978 | Dines | 175/4.6 |
| 4,078,611 | 3/1978 | Vann | 166/297 |
| 4,106,561 | 8/1978 | Jerome et al. | 166/55.2 |
| 4,113,016 | 9/1978 | Trott | 166/297 |
| 4,119,148 | 10/1978 | Deardorf | 166/250 |
| 4,122,899 | 10/1978 | Brieger | 166/297 |
| 4,180,131 | 12/1979 | Chammas | 166/297 |
| 4,208,966 | 6/1980 | Hart | 102/20 |
| 4,352,397 | 10/1982 | Christopher | 166/297 |
| 4,354,433 | 10/1982 | Owen | 102/307 |
| 4,357,873 | 11/1982 | Jager | 102/310 |
| 4,409,481 | 10/1983 | Huber et al. | 166/297 |
| 4,509,604 | 4/1985 | Upchurch | 175/4.52 |
| 4,511,296 | 4/1985 | Stol | 411/20 |
| 4,560,000 | 12/1985 | Upchurch | 166/55.1 |
| 4,598,769 | 7/1986 | Robertson | 166/55 |
| 4,601,498 | 7/1986 | Haugen | 285/332.3 |
| 4,612,985 | 9/1986 | Rubbo et al. | 166/114 |
| 4,614,156 | 9/1986 | Colle, Jr. et al. | 102/312 |
| 4,616,718 | 10/1986 | Gambertoglio | 175/4.54 |
| 4,637,478 | 1/1987 | George | 175/4.51 |
| 4,655,298 | 4/1987 | George et al. | 175/4.52 |
| 4,662,450 | 5/1987 | Haugen | 166/299 |
| 4,669,540 | 6/1987 | Luoma et al. | 166/135 |
| 4,694,754 | 9/1987 | Dines et al. | 102/310 |
| 4,699,241 | 10/1987 | Kerekes | 181/116 |
| 4,716,963 | 1/1988 | George et al. | 166/123 |
| 4,726,610 | 2/1988 | George et al. | 285/39 |
| 4,744,424 | 5/1988 | Lenderman et al. | 175/4.51 |
| 4,760,884 | 8/1988 | Haugen et al. | 166/377 |
| 4,762,179 | 8/1988 | Wesson et al. | 166/297 |
| 4,787,315 | 11/1988 | Kenny | 102/313 |
| 4,796,709 | 1/1989 | Lynde et al. | 166/55.6 |
| 4,798,244 | 1/1989 | Trost | 166/250 |
| 4,800,958 | 1/1989 | Haugen et al. | 166/55.1 |
| 4,886,126 | 12/1989 | Yates, Jr. | 175/4.54 |
| 4,887,668 | 12/1989 | Lynde et al. | 166/55.8 |
| 4,898,244 | 2/1990 | Schneider et al. | 166/297 |
| 4,901,802 | 2/1990 | George et al. | 175/4.52 |
| 4,905,759 | 3/1990 | Wesson et al. | 166/55 |
| 4,909,320 | 3/1990 | Hebert et al. | 166/55.1 |
| 4,924,952 | 5/1990 | Schneider | 175/4.54 |
| 4,938,291 | 7/1990 | Lynde et al. | 166/55.8 |
| 4,969,525 | 11/1990 | George et al. | 166/297 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,016,716 | 5/1991 | Donovan et al. | 175/17 |
| 5,022,485 | 6/1991 | Mitchell | 181/106 |
| 5,038,859 | 8/1991 | Lynde et al. | 166/55.6 |
| 5,044,437 | 9/1991 | Wittrisch | 166/250 |
| 5,054,555 | 10/1991 | Lalande et al. | 166/298 |
| 5,058,666 | 10/1991 | Lynde et al. | 166/55.6 |
| 5,067,568 | 11/1991 | Yates, Jr. et al. | 175/4.52 |
| 5,086,838 | 2/1992 | Cassel et al. | 166/55.6 |
| 5,101,907 | 4/1992 | Schultz et al. | 166/386 |
| 5,103,906 | 4/1992 | Schultz et al. | 166/264 |
| 5,103,911 | 4/1992 | Heijnen | 166/297 |
| 5,111,885 | 5/1992 | Umphries | 166/297 |
| 5,150,755 | 9/1992 | Cassel et al. | 166/297 |
| 5,167,282 | 12/1992 | Schneider et al. | 166/297 |
| 5,177,321 | 1/1993 | Kenny | 102/312 |
| 5,199,513 | 4/1993 | Stewart et al. | 175/73 |
| 5,238,070 | 8/1993 | Schultz et al. | 166/386 |
| 5,279,363 | 1/1994 | Schultz et al. | 166/53 |
| 5,297,630 | 3/1994 | Lynde et al. | 166/297 |
| 5,301,755 | 4/1994 | George et al. | 166/297 |
| 5,355,957 | 10/1994 | Burleson et al. | 166/297 |
| 5,370,186 | 12/1994 | Ireland | 166/297 |
| 5,373,900 | 12/1994 | Lynde et al. | 166/297 |
| 5,381,631 | 1/1995 | Raghavan et al. | 451/75 |
| 5,435,394 | 7/1995 | Robertson | 166/382 |
| 5,456,312 | 10/1995 | Lynde et al. | 166/55.6 |
| 5,467,824 | 11/1995 | DeMarsh et al. | 166/297 |
| 5,477,785 | 12/1995 | Dieman et al. | 102/313 |
| 5,483,895 | 1/1996 | Tomek et al. | 102/312 |
| 5,490,563 | 2/1996 | Wessan et al. | 166/297 |
| 5,503,077 | 4/1996 | Motley | 102/202.5 |
| 5,503,078 | 4/1996 | LeTual | 102/202.13 |
| 5,505,260 | 4/1996 | Anderson et al. | 166/278 |
| 5,505,261 | 4/1996 | Huber et al. | 166/297 |
| 5,524,523 | 6/1996 | Lubbe et al. | 86/20.15 |
| 5,531,164 | 7/1996 | Mosley | 102/312 |
| 5,540,293 | 7/1996 | Mohaupt | 175/3.5 |
| 5,542,480 | 8/1996 | Owen et al. | 175/4.15 |
| 5,551,344 | 9/1996 | Couet et al. | 102/312 |
| 5,590,723 | 1/1997 | Walker et al. | 175/4.6 |
| 5,598,894 | 2/1997 | Burleson et al. | 175/4.52 |
| 5,603,379 | 2/1997 | Henke et al. | 166/297 |
| 5,613,557 | 3/1997 | Blount et al. | 166/277 |
| 5,632,348 | 5/1997 | Yunan | 175/4.54 |
| B1 3,706,344 | 7/1985 | Vann | 166/297 |

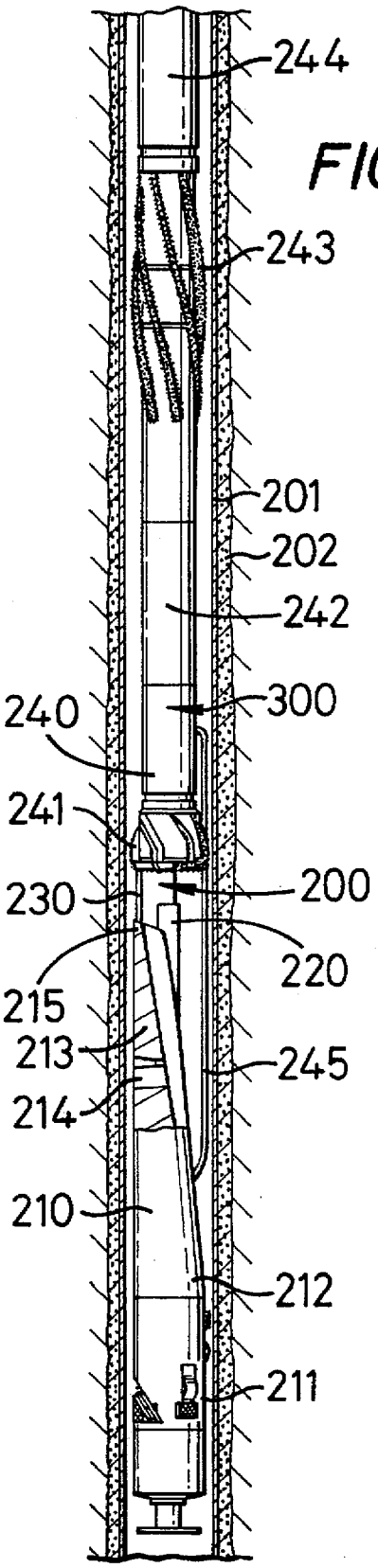
FIG. 7
FIG. 8c
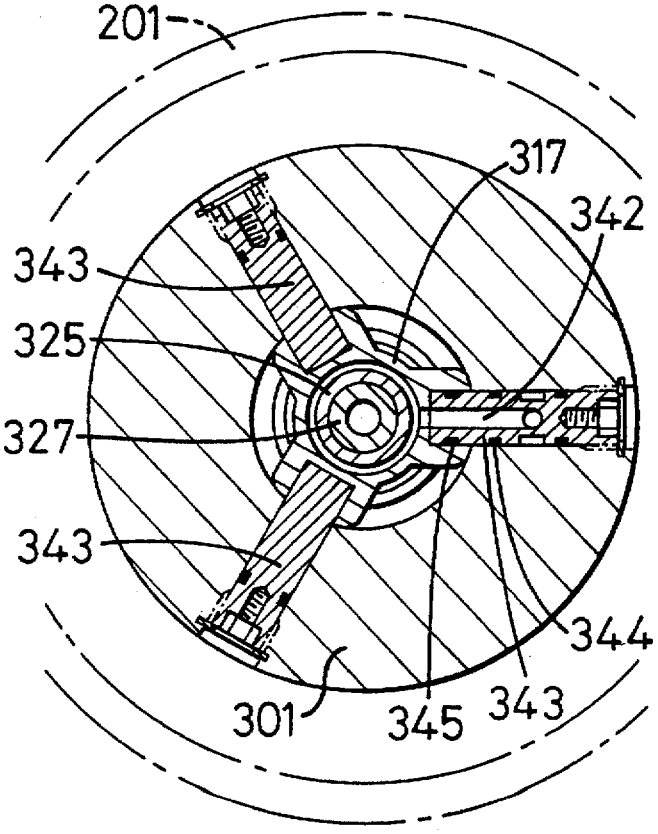

WELLBORE WINDOW FORMATION

RELATED APPLICATION

This is a Continuation-In-Part of U.S. application Ser. No. 08/568,878 filed on Dec. 11, 1995 entitled "Starting Mill And Operations" now U.S. Pat. No. 5,636,692, co-owned with this application and the present invention.

BACKGROUND OF THE INVENTION

1. Field Of The Invention

This invention is related to apparatuses and methods for forming a window in a casing in a wellbore.

2. Description of Related Art

The practice of producing oil from multiple radially dispersed reservoirs, through a single primary wellbore has increased dramatically in recent years. To facilitate this, "kick-off" technology has been developed and continues to grow. This technology allows an operator to drill a vertical well and then continue drilling one or more angled or horizontal holes off of that well at chosen depth(s). Because the initial vertical wellbore is often cased with a string of tubular casing, a "window" must be cut in the casing before drilling the "kick-off". In certain prior art methods windows are cut using various types of milling devices and one or more "trips" of the drill string are needed. Rig. time is very expensive and multiple trips take time and add to the risk that problems will occur.

Another problem encountered in certain typical milling operations is "coring". Coring occurs when the center line of a window mill coincides with the wall of the casing being milled (i.e. the mill is half in and half out of the casing). As the mill is rotating, the point at its centerline has a velocity of zero. A mill's capacity to cut casing depends on some relative velocity between the mill face and the casing being cut. When the centerline of the mill contacts the casing wall its cutting capacity at that point is greatly reduced because the velocity near the centerline is very low relative to the casing and zero at the axial centerline. The milling rate may be correspondingly reduced.

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge adjacent or beneath the cutting blades. An upward flow of the discharged fluid in the annulus outside the tool removes cuttings or chips from the well resulting from the milling operation.

Milling tools have been used for removing a section of existing casing from a well bore to permit a sidetracking operation in directional drilling and to provide a perforated production zone at a desired level. Also, milling tools are used for milling or reaming collapsed casing and for removing burrs or other imperfections from windows in the casing system.

Prior art sidetracking methods use cutting tools of the type having cutting blades. A deflector such as a whipstock causes the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation may require a plurality of "trips" into the wellbore. For example, in certain multi-trip operations, an anchor, slip mechanism, or an anchor-packer is set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is releasably secured at the top of the whipstock, e.g. with a shearable setting stud and nut connected to a pilot lug on the whipstock. The tool is then lowered into the wellbore so that the anchor device or packer engages the stinger and the tool is oriented. Slips extend from the stinger and engage the side of the wellbore to prevent movement of the tool in the wellbore; and locking apparatus locks the stinger in a packer when a packer is used. Pulling on the tool then shears the setting stud, freeing the starting mill from the tool. Certain whipstocks are also thereby freed so that an upper concave portion thereof pivots and moves to rest against a tubular or an interior surface of a wellbore. Rotation of the string with the starting mill rotates the mill. The starting mill has a tapered portion which is slowly lowered to contact a pilot lug on the concave face of the whipstock. This forces the starting mill into the casing and the casing is milled as the pilot lug is milled off. The starting mill moves downwardly while contacting the pilot lug or the concave portion and cuts an initial window in the casing. The starting mill is then removed from the wellbore. A window mill, e.g. on a flexible joint of drill pipe, is lowered into the wellbore and rotated to mill down from the initial window formed by the starting mill. A watermelon mill may be used behind the window mill for rigidity; and to lengthen the casing window if desired. Typically then a window mill with a watermelon mill mills all the way down the concave face of the whipstock forming a desired cut-out window in the casing. Then, the window mill is removed and, as a final option, a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

The prior art discloses a variety of chemical and explosive casing cutters and casing perforators. These apparatuses are used to sever casing at a certain location in a wellbore or to provide perforations in casing through which fluid may flow.

There has long been a need for efficient and effective wellbore casing window methods and tools useful in such methods particularly for drilling side or lateral wellbores. There has long been a need for an effective "single trip" method for forming a window in wellbore casing.

SUMMARY OF THE PRESENT INVENTION

The present invention, in one embodiment, discloses a method for forming an opening in a wellbore casing which includes introducing an apparatus including a whipstock or other drill bit or mill diversion device into the wellbore and locating it at a desired point in the wellbore. In one aspect a drill bit is releasably connected to the diversion device. In one aspect a window mill is releasably connected to the whipstock. To create a hole through which drilling of the formation adjacent the hole is possible or to initiate a starting hole or slot for milling in the casing, a shaped charge of explosive is attached to the apparatus. In one aspect the charge is attached to a drill bit; in one aspect to the diversion device; and in another aspect to the window mill. In one aspect the charge is attached below the window mill. The explosive charge is properly designed to form a hole of desired shape and configuration in the casing without damaging the whipstock, drill bit, window mill, or adjacent casing; and, in certain aspects, to form the beginning of a lateral bore in formation adjacent to a wellbore tubular. The explosive is also designed to create a minimum of debris in the wellbore.

In certain embodiments the size, shape, and character of the hole created by the explosive charge is directly dependant on the design of the charge. The relationship between the shape of the charge and the shape of the hole is known as the "Munroe effect"; i.e., when a particular indentation is configured in the "face" of an explosive charge, that configuration is mirrored in a target when the charge is detonated adjacent to the target. Additional enhancement of desired final target configurations is obtained by the use of multiple precision timed explosive initiation, explosive lensing, and internal explosive wave shaping.

In one embodiment an explosive charge (e.g. a linear jet shape charge) is run into a cased wellbore with a whipstock so that the charge is directed 180 degrees from the whipstock concave. It is detonated at the depth that corresponds to the depth of the window mill at which coring is anticipated. This charge cuts an axial slot out of the casing wall so that when the mill encounters the slot, there is no casing on its centerline (casing in that area having been previously removed by the charge), thus preventing coring.

The present invention, in certain embodiments, discloses an apparatus for forming an opening in casing in a cased wellbore, the apparatus having a location device for locating the apparatus in the casing, and an explosive device interconnected with the location device for explosively forming an opening in the casing; in one aspect the opening being a window suitable for wellbore sidetracking operations; such apparatus with the location device including an orienting device for orienting the explosive means radially within the wellbore and the location device including a diversion device for directing a drill bit or a mill; and drill bit for drilling into the formation adjacent the opening or a milling apparatus for milling the casing at the opening, the milling apparatus releasably attached to the location means; such apparatus with the location device having a whipstock with a concave, and milling device or devices for milling the casing releasably connected to the location means; such apparatus wherein the milling device is a window mill; such apparatus wherein the milling devices include at least two mills; such an apparatus wherein the location device includes an anchor apparatus for anchoring the location device in the wellbore; such an apparatus wherein the explosive device is connected to the diversion device and the apparatus has at least one explosive charge sized, configured and located for producing an opening, slot, radial ledge or completed window of a desired size, shape and location in the casing, and a detonator device for detonating the at least one explosive charge; such apparatus wherein the at least one explosive charge is a plurality of explosive charges; such an apparatus wherein the detonator device includes a timer for activating the detonator device at a desired time; such an apparatus including a sequence device for activating the explosive prior to drilling or prior to milling of casing by a mill or mills; such an apparatus wherein the at least one explosive charge is sized, shaped, configured and located so that the opening defines an opening, e.g. a slot, in the casing located to inhibit or prevent coring of a mill milling at the window.

The present invention, in certain embodiments, discloses an apparatus for forming a window in casing in a cased wellbore, the apparatus having a location device for locating the apparatus in the casing; an explosive device interconnected with the location device for explosively forming a window in the casing, the explosive device including at least one explosive charge sized, configured and located for producing a window of a desired size, shape and location in the casing; and a detonator device for detonating the at least one explosive charge; the location device including a whipstock with a concave, and an anchor device for anchoring the location device in the wellbore; and milling apparatus releasably connected to the location device, the milling apparatus including a window mill and/or another mill or mills.

The present invention, in certain embodiments, discloses an apparatus for forming a window in casing in a cased wellbore, the apparatus having a location device for locating the apparatus in the casing, and an explosive device connected to the location device for explosively forming a slot in the casing, the slot defining an opening in the casing located to inhibit or prevent coring of a mill milling at the slot; such an apparatus wherein the location device includes a whipstock with a concave, and the apparatus further has milling apparatus releasably connected to the location means; such an apparatus with the milling apparatus including a window mill; such an apparatus wherein the location device has an anchor device for anchoring the location device in the wellbore; such an apparatus wherein the explosive device has at least one explosive charge sized, configured and located for producing a slot of a desired size, shape and location in the casing, and a detonator device for detonating the at least one explosive charge.

The present invention, in certain embodiments, discloses an apparatus for forming a radial ledge in casing in a cased wellbore, the apparatus having a location device for locating the apparatus in the casing, and an explosive device connected to the location device for explosively forming a radial ledge in the casing, the ledge defining an opening in the casing located to enhance initial casing penetration by a mill milling at the ledge.

The present invention, in certain embodiments, discloses an apparatus for forming a window in casing in a cased wellbore, the apparatus having a location device for locating the apparatus in the casing, and an explosive device connected to the location device for explosively forming a radial ledge and an axial slot in the casing, the combined configuration defining an opening in the casing located to enhance initial casing penetration by a mill, and inhibit or prevent coring of a mill milling at the slot; such an apparatus wherein the mill is releasably attached to the location device; such an apparatus wherein the explosive device is attached to the mill; and such an apparatus wherein the location device has a whipstock with a concave, and the apparatus includes milling apparatus for milling casing releasably connected to the location means.

The present invention, in certain embodiments, discloses a method for forming an opening in a casing of a cased wellbore, the method including locating an opening-forming system at a desired location in casing in a wellbore, the opening-forming system having a location device for locating the apparatus in the casing, and an explosive device connected to the location device for explosively forming an opening in the casing, the opening for facilitating wellbore sidetracking operations, the explosive device including an explosive charge, and the method including exploding the explosive charge adjacent the casing to explosively form the opening; such a method wherein a drill bit is connected to the location device and the method including drilling formation adjacent the opening created by the opening-forming system; such a method wherein the location device includes a whipstock with a concave, and the apparatus device has milling apparatus releasably connected to the location device and the method includes milling at the opening with the milling means; such a method wherein the at least one explosive charge is sized, shaped, configured and located so that the opening created in the casing is located to inhibit or prevent coring of a mill milling at the opening; and such a method wherein the opening includes a radial ledge in the casing for facilitating casing penetration by a mill milling at the ledge.

It is, therefore, an object of at least certain preferred embodiments of the present invention to provide:

New, useful, unique, efficient, non-obvious methods and systems for the formation of an opening in wellbore casing;

Such systems with an explosive charge for initiating a hole in casing;

Such systems for drilling formation adjacent such a hole;

Such systems in which the opening is a window suitable for sidetracking operations;

Such systems useful for milling casing and, in one aspect, for removing a portion of a casing, e.g. a longitudinal slot, to inhibit or prevent mill coring;

Such systems for forming a radial ledge in casing for facilitating milling of the casing;

Such systems which product minimal debris upon activation;

Such systems with which a casing window is formed in a single trip in the hole; and Methods employing such systems for creating an opening; for subsequent milling of casing; and/or for subsequent drilling of formation adjacent an opening.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 7 is a side view in cross-section of a system according to the present invention.

FIGS. 19*b* and 19*c* are schematic side views in cross-section showing steps in a method of use of the system of FIG. 21*a*.

DESCRIPTION OF EMBODIMENTS PREFERRED AT THE TIME OF FILING FOR THIS PATENT

Figure 1:
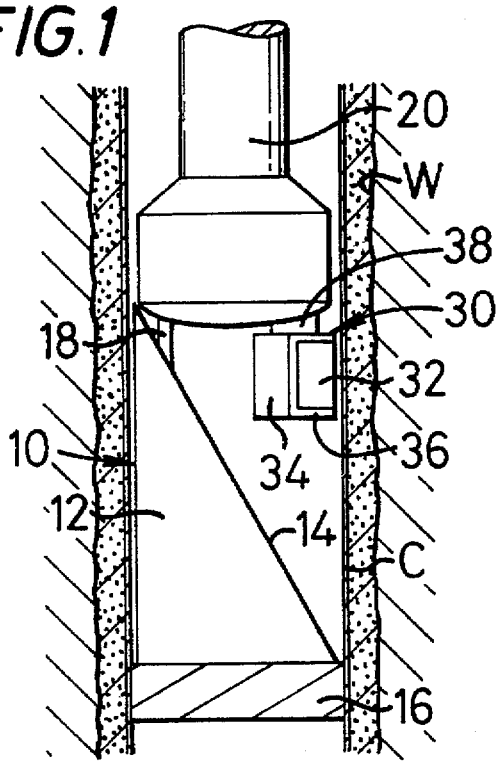
FIG. 1 is a side cross-sectional view of a system according to the present invention.

Referring now to FIG. 1, a system 10 according to the present invention is shown schematically in a wellbore W cased with casing C. The system 10 includes a whipstock 12 with a concave face 14 anchored by an anchor device 16 in the wellbore W. A window mill 20 is releasably connected to the whipstock 12 e.g. with a shear stud 18 (or with an hydraulic release device).

An explosive charge system 30 is secured to the whipstock 12 (e.g. by any suitable securement apparatus, device, or method) (or to the window mill 20). Shock attenuation material 36 is preferably disposed on the sides of the explosive charge except the side facing the casing. The system 30 includes a typical amount of an explosive 32 and a typical detonator device 34. The explosive 32 may be detonated at a desired moment in time using any suitable known apparatus or mechanism.

Detonation may be effected by employing drill string pressure, annulus pressure, pressure sequencing, mechanical devices (e.g. bar drop through drill string I.D.), or electric wireline run.

The explosive 32 is sized and configured to create a hole in the casing of desired size, location, and configuration. The window mill 20 is located so that it takes advantage of the hole created by the system 30 and can complete the formation of a window in the casing in a single trip of the system 10 into the hole.

Figure 2:
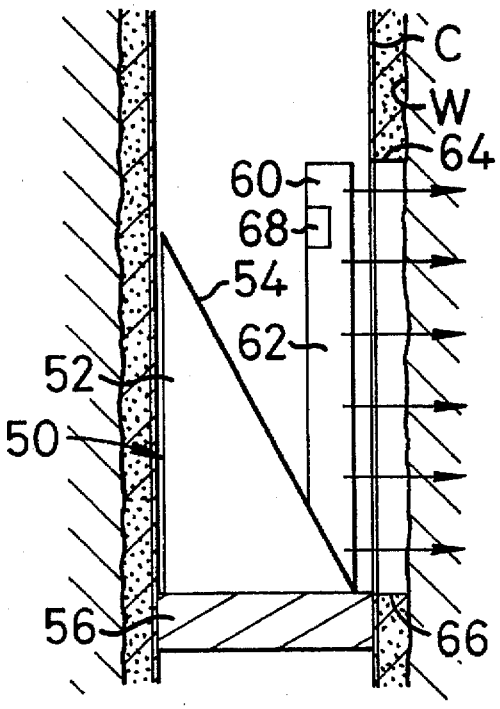
FIG. 2 is a side cross-sectional view of a system according to the present invention.

FIG. 2 illustrates schematically a system 50 according to the present invention in a wellbore W cased with casing C. The system 50 with a concave face 54 anchored in the wellbore W with an anchor 56.

An explosive charge system 60 is secured to the whipstock 52 and is shaped, sized, and configured to form a slot in the casing C between the points 64, 66. Rather than encountering casing and producing coring of a mill (not shown; like the window mill 20, FIG. 1), a mill encounters the slot and coring is inhibited or prevented. Preferably the explosive charge system 60 is self-consuming and no part of it remains after the explosion on the whipstock or in the slot to inhibit subsequent milling. The system 60 may include any known mill or multiple mill combination. The system 60 includes an amount of known explosive 62 and a detonator apparatus 68. The whipstock 52 may be any known whipstock or mill diversion device; the whipstock 52 may be a hollow whipstock. The arrows in FIG. 2 indicate the direction of the effects of the explosion of the explosive 62.

Figure 3:
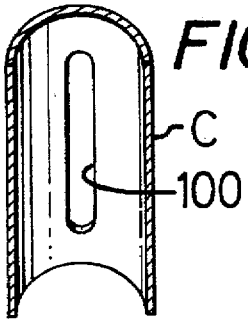
FIG. 3 is a schematic view of a slot formed in casing using a system according to the present invention.

FIG. 3 shows casing C with a slot 100 formed therethrough explosively with a system according to the present invention as described above at a desired location for a completed window for wellbore sidetracking operations. Additional milling at the slot will complete a window and, as a mill moves down the slot coring of the mill when it is half in and half out of the casing is inhibited or prevented.

Figure 4:
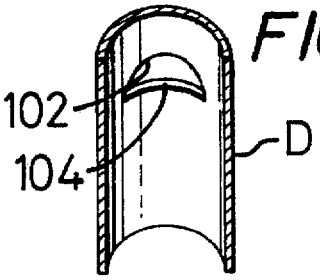
FIG. 4 is a schematic view of a radial ledge opening formed in casing using a system according to the present invention.

FIG. 4 shows a casing D with a hole 102 and a radial ledge 104 therethrough formed explosively with a system according to the present invention. Such a hole and ledge facilitate initial milling starting at the location of the ledge.

Figure 5:
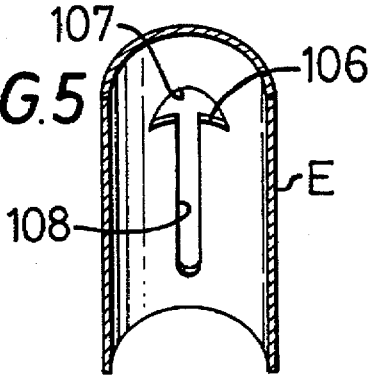
FIG. 5 is a schematic view of an opening in casing including a radial ledge and a slot formed using a system according to the present invention.

FIG. 5 shows a casing E with a composite opening formed explosively with a system as described above with a ledge 106 (like the ledge 104), a hole 107 (like the hole 102), and a slot 108 (like the slot 100) to facilitate milling at the location of the ledge and slot.

Figure 6:
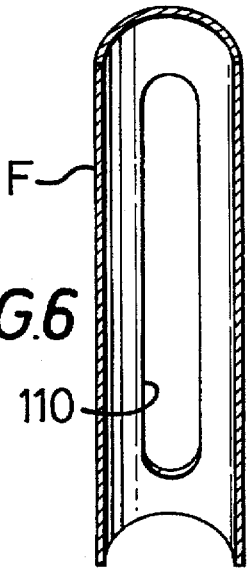
FIG. 6 is a schematic view of a window opening formed in casing using a system according to the present invention.

FIG. 6 shows a casing F with a completed wellbore sidetracking window 110 formed explosively with a system as described above.

FIG. 7 shows a system 200 according to the present invention which has a whipstock 210, an explosive device 220, an extender 230, and a milling apparatus 240. The system 200 is in a string of casing 201 in a wellbore 202.

The whipstock 210 may be any known diverter, mill guide or whipstock, including, but not limited to, concave-hinged and concave-integral whipstocks, solid whipstocks, hollow whipstocks, soft-center whipstocks, retrievable whipstocks, anchor whipstocks, anchor-packer whipstocks, bottom set whipstocks, and permanent set whipstocks. As shown the whipstock 210 is any hydraulic set whipstock with a lower hydraulically-set anchor apparatus 211, a body 212, a concave 213, a retrieval slot 214, and a top end 215.

The milling apparatus 240 is spaced-apart from and interconnected with the whipstock 210 by the extender 230. The extender 230 may be made of any suitable material, including but not limited to steel, mild steel, stainless steel, brass, fiberglass, composite, ceramic, cermet, or plastic. In one aspect brass is used because it is easily millable. One, two, three or more extenders may be used. The extender 230 spaces the milling apparatus away from the area of maximum explosive effect and permits the explosive device 220 to extend above the top of the concave 213 so that an opening is formed in the casing 201, thus facilitating the initiation of milling at a point above or even with the top end 215 of the concave 213. Shear pins 324 pin the extender 230 to the mill 241.

The explosive device 220 may be any known explosive device suitable for making a desired hole or opening in the casing 201. As shown the explosive device 220 is positioned adjacent the concave 213 with a portion extending above the concave 213. The explosive device may be positioned at any desired point on the concave 213. Alternatively it may be secured to the extender 230 or it may be suspended to and below the milling apparatus 240.

The milling apparatus 240 may be any suitable milling or drilling apparatus with any suitable known bit, mill or mills. As shown the milling apparatus 240 has a starting mill 241, a firing head 300, a tubular joint 242 and a watermelon mill 243 which is connected to a tubular string 244 that extends to the surface. The milling apparatus 240 may be rotated by a downhole motor in the tubular string 244 or by a rotary table. An hydraulic fluid line 245 extends from the firing head 300 to the whipstock 210. The hydraulic fluid line 245 intercommunicates with a pressure fluid supply source at the surface (not shown) via an internal bore of a body of the firing head 300 and fluid under pressure is transmitted through the fluid line 245, through the whipstock 210, to the anchor apparatus 211.

Figure 8A:
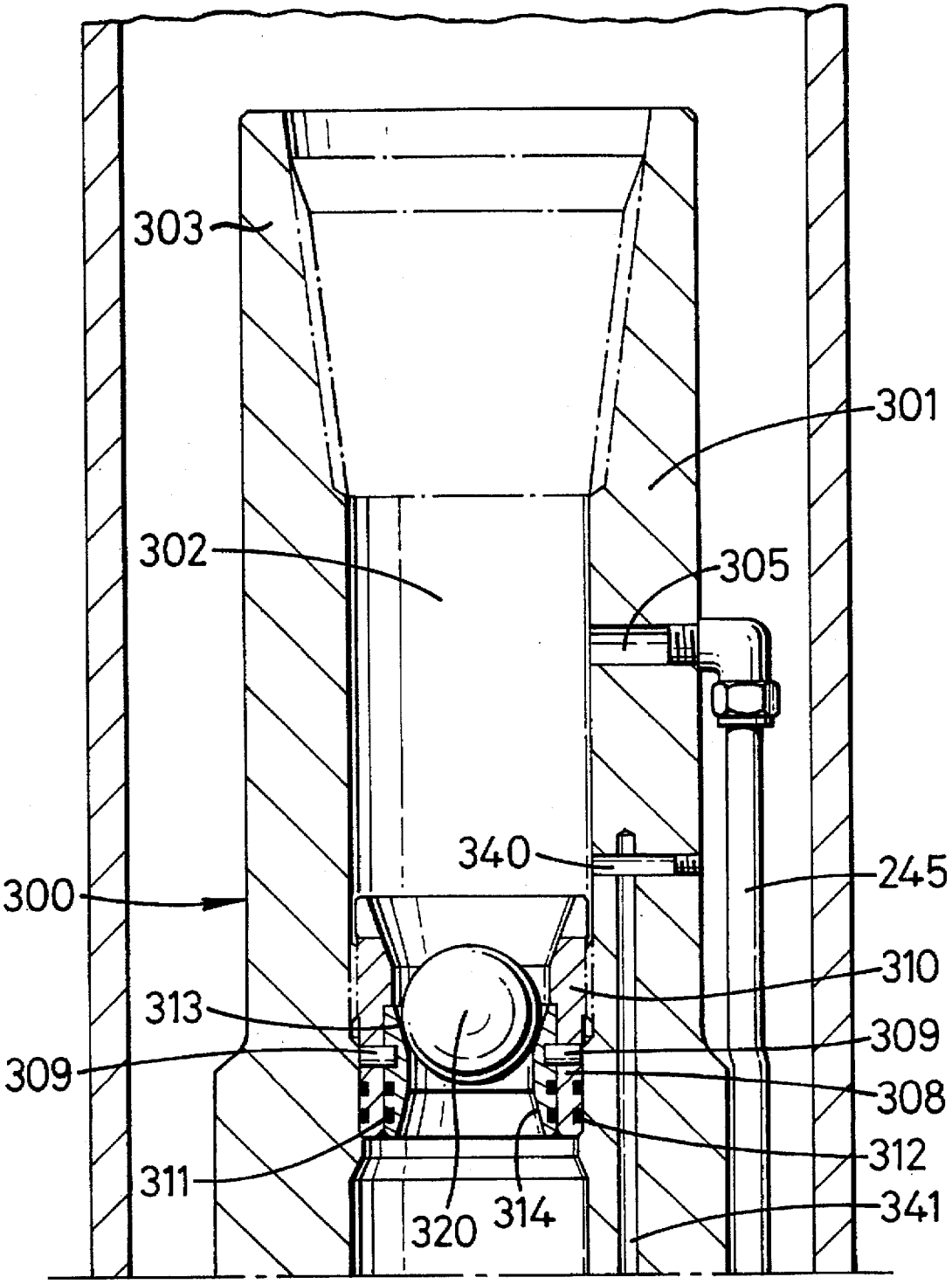
FIG. 8*a* is a cross-section view of a firing head and mill of the system of FIG. 7.
Figure 8B:
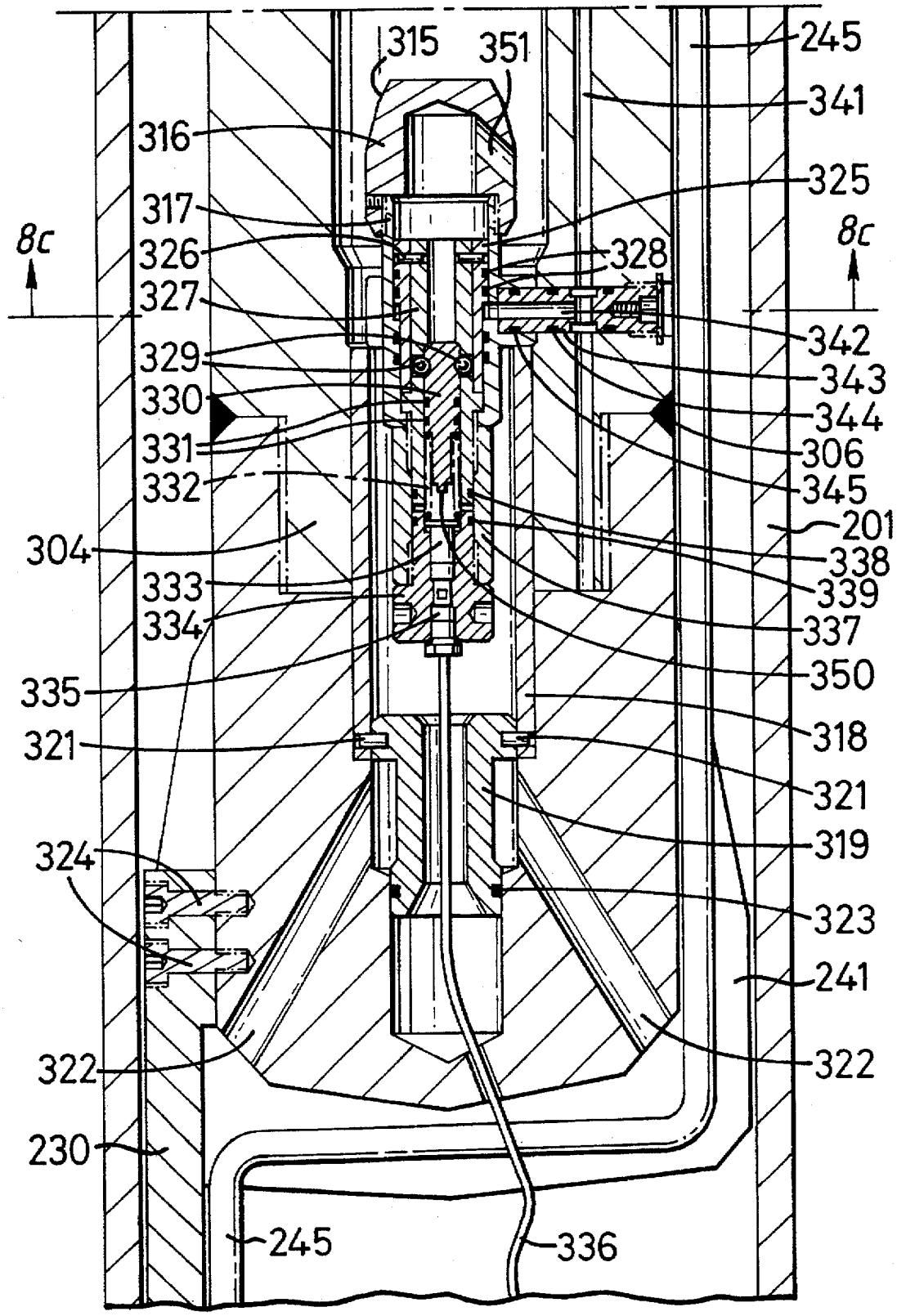
FIG. 8*b* is a cross-section view along line 8*b*—8*b* of FIG. 8*a*.
Figure 9:
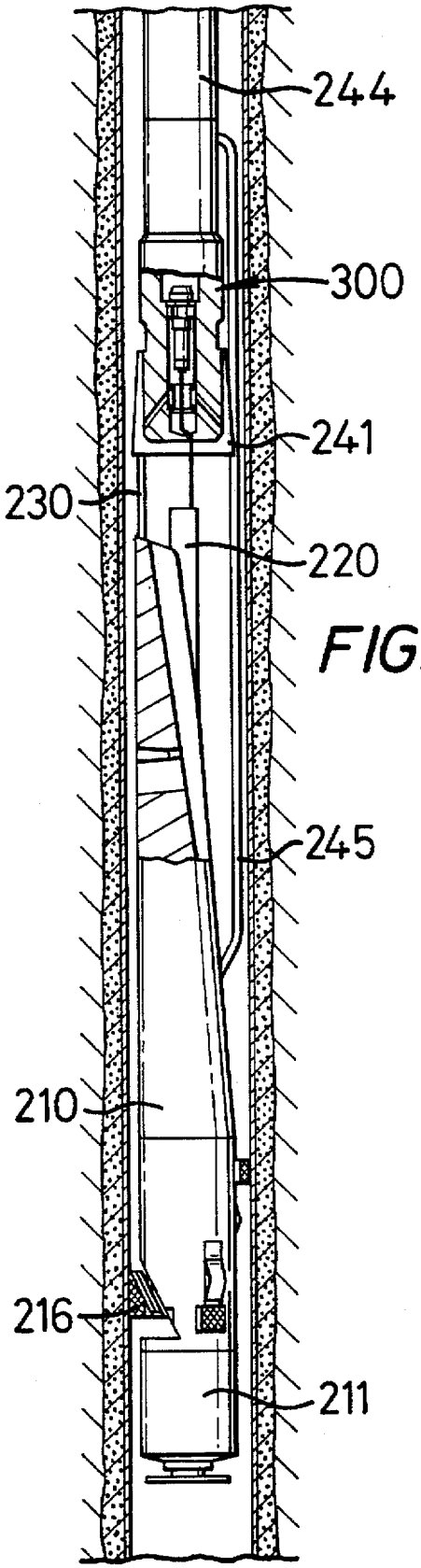
FIGS. 9–13 are side cross-section views that illustrate steps in a method of use of the system of FIG. 7.

As shown in FIGS. 8*a* and 8*b*, the firing head 300 has a body 301 with a fluid bore 302 extending therethrough from a top end 303 to a bottom end 304. The fluid line 245 is in fluid communication with the bore 302 via a port 305. The body 301 may be an integral part as shown welded at 306 to the mill 241. This firing head may be used in or with a mill or in or with a bit.

A ball seat 308 is shear-pinned with one or more pins 309 to a ball guide 310. A seal 311 seals the ball-seat-ball-guide interface and a seal 312 seals the ball-guide-body interface. The ball seat 308 has a seating surface 313 against which a ball 320 can sealingly seat to stop flow through the bore 302. The ball guide 310 may be threadedly secured to the body 301.

A tapered surface 314 on the ball seat 308 is fashioned and shaped to facilitate reception of a tapered upper portion 315 of a tower 316 when the pins 309 are sheared and the ball seat 308 moves down in the body 301. The tower 316 is threadedly secured to a body 317 which is mounted on an inner sleeve 318 in the bore 302. A mid body 337 spaces apart the body 317 and a lower body 334. A sleeve 319 is shear pinned with one or more pins 321 to the inner sleeve 318. Initially the sleeve 319 prevents fluid flow to mill ports 322. A seal 323 seals the sleeve-body interface. A seal 338 seals the mid-body-cylinder interface. A seal 339 seals the lower-body-mid-body interface.

A movable piston 325 is initially held in place in the body 317 by shear pins 326 that pin the piston 325 to a cylinder 327. Seals 328 seal the piston-body interface. Balls 329 initially hold a firing piston 330. The balls 329 are initially held in place in holes in the cylinder 327 and prevented from moving out of the holes by the piston 325, i.e., from moving outwardly to free the firing piston 330. Seals 331 seal the firing-piston-cylinder interface.

When the firing piston 330 is freed, a spring 332 urges it away from a percussion initiator 333. The percussion initiator 333 is mounted at a top end of the lower body 334. A booster detonator 335 is held in a lower end of the lower body 334 and is situated to receive the effects of the percussion initiator 333 (e.g., a known and commercially available percussion initiator with a "flyer" that is explosively directed away from the initiator upon detonation). The booster detonator 335 is interconnected with detonation cord 336. Fluid under pressure flows selectively through a port 340 from the bore 302 to a bore 341 which is in fluid communication with bores 342 through liners 343 (see FIG. 8*b*). Fluid from the bore 342 acts on the movable piston 325. A seal 344 seals the liner-body 301 interface. A seal 345 seals the liner-body 317 interface.

Figure 10:
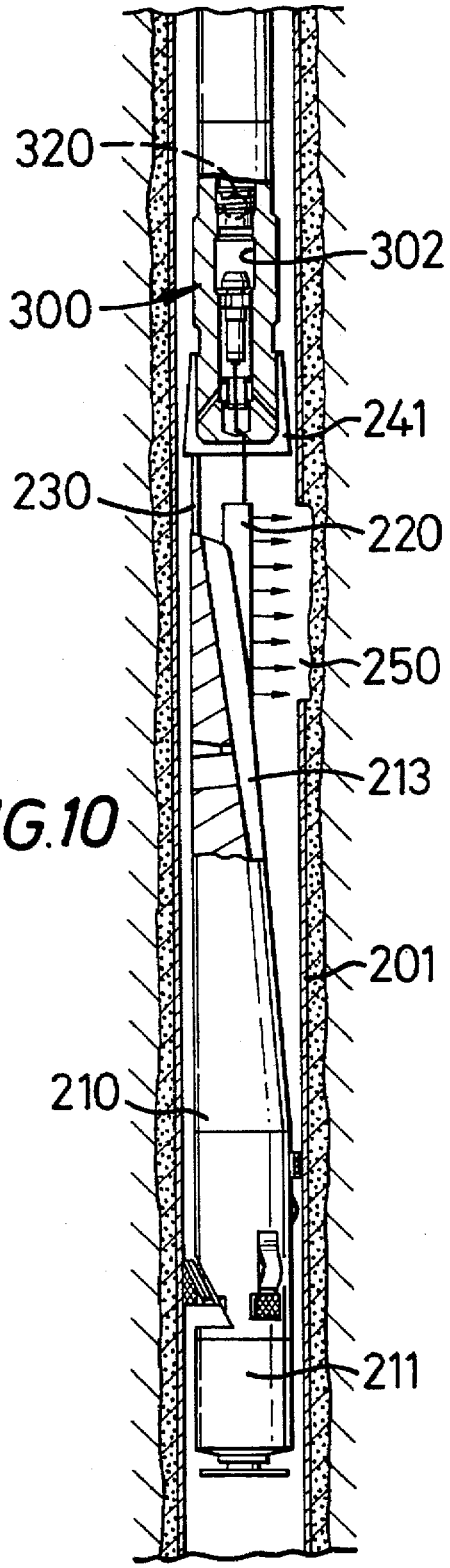

As shown in FIG. 10, a ball 320 has dropped to close off flow through the bore 302 and the pressurized fluid applied through the bore 342 has sheared the pins 326 freeing the movable piston 325 for upward movement due to the force of the fluid. This in turn allows the balls 329 to move outwardly freeing the firing piston 330 (which has a captive fluid e.g. air below it at a pressure less than the hydrostatic pressure above the piston, e.g. air at atmospheric pressure below the piston) so that its firing pin 350 strikes the percussion initiator 333. The percussion initiator 333 detonates and (as is typical) its flyer plate is directed by detonation of the percussion initiator 333 to the detonator booster 335 which in turn detonates the detonator booster 335, detonation cord 336, and hence the explosive device 220, creating an opening 250 in the casing 201.

Figure 11:
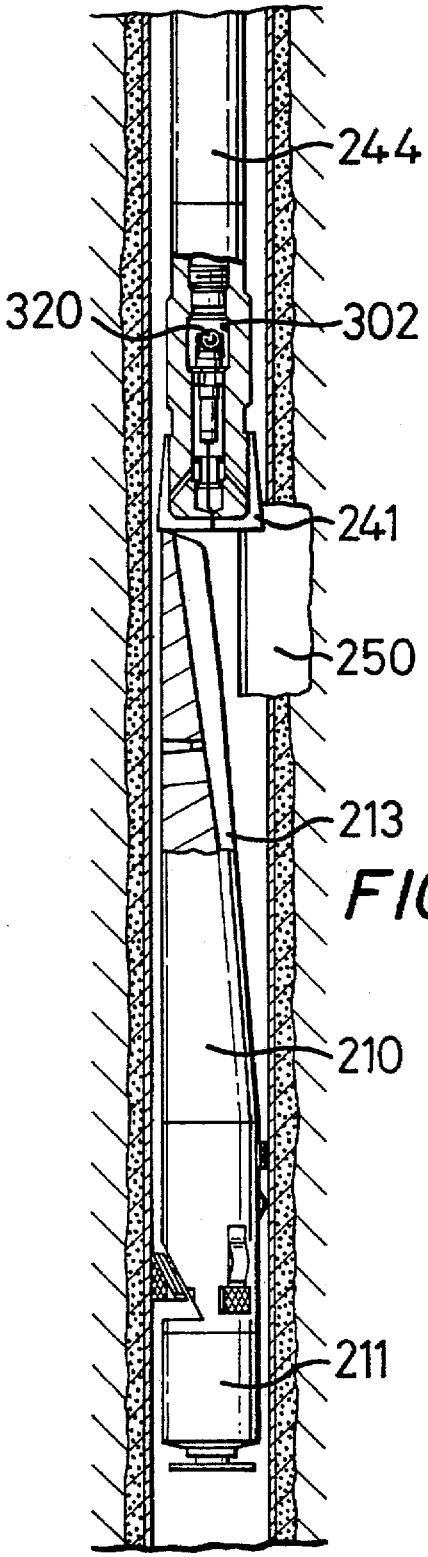
Figure 12:
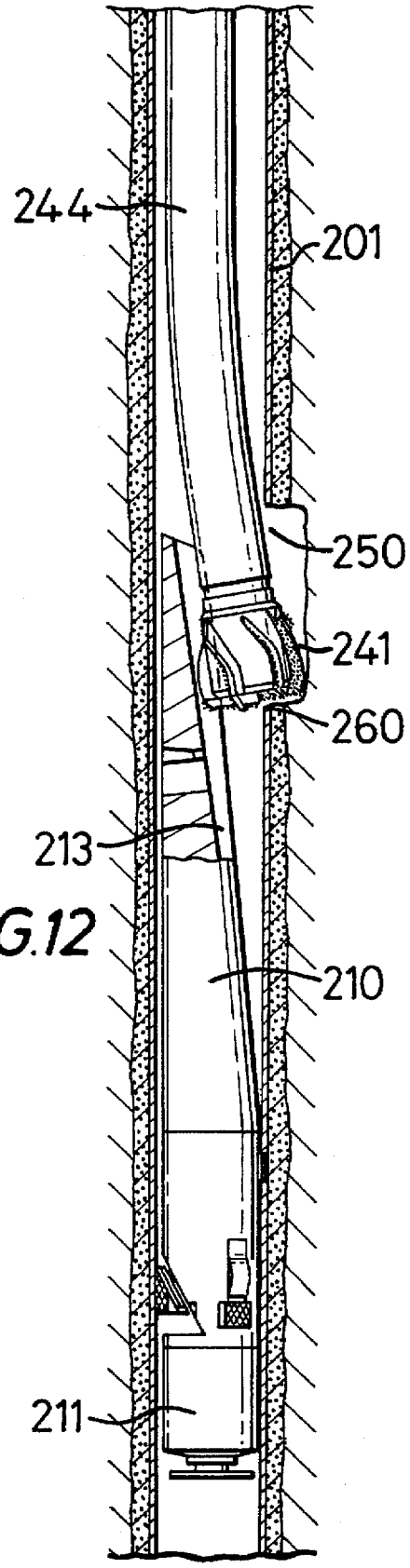

As shown in FIG. 11, fluid pressure through the bore 302 has been increased so that the pins 309 are sheared and the ball 320 and ball seat 308 move down onto the tower 316. In this position (as in the position of FIG. 7) fluid flows between the ball seat 308 and the interior wall of the body 301 into and through a port 351 into a space below the tower 316 and above a top end of the firing piston 330. Fluid flows down to the sleeve 319 between the liners 343, through the bore 302 between the sleeve 318 and the mid body 337, to the space adjacent the sleeve 319 to shear pins 321 to permit fluid to circulate through ports 322 for milling. The mill 241 has been raised, lowered, or rotated to shear the pins 324 and the mill 241 has milled away the extender 230. As shown in FIG. 11, the mill 241 has progressed downwardly and is adjacent the opening 250. As shown in FIG. 12, the mill 241 has milled the casing 201 beyond the opening 250 and has commenced milling a desired window 260. The mill 241 is moving down the concave 213.

Figure 13:
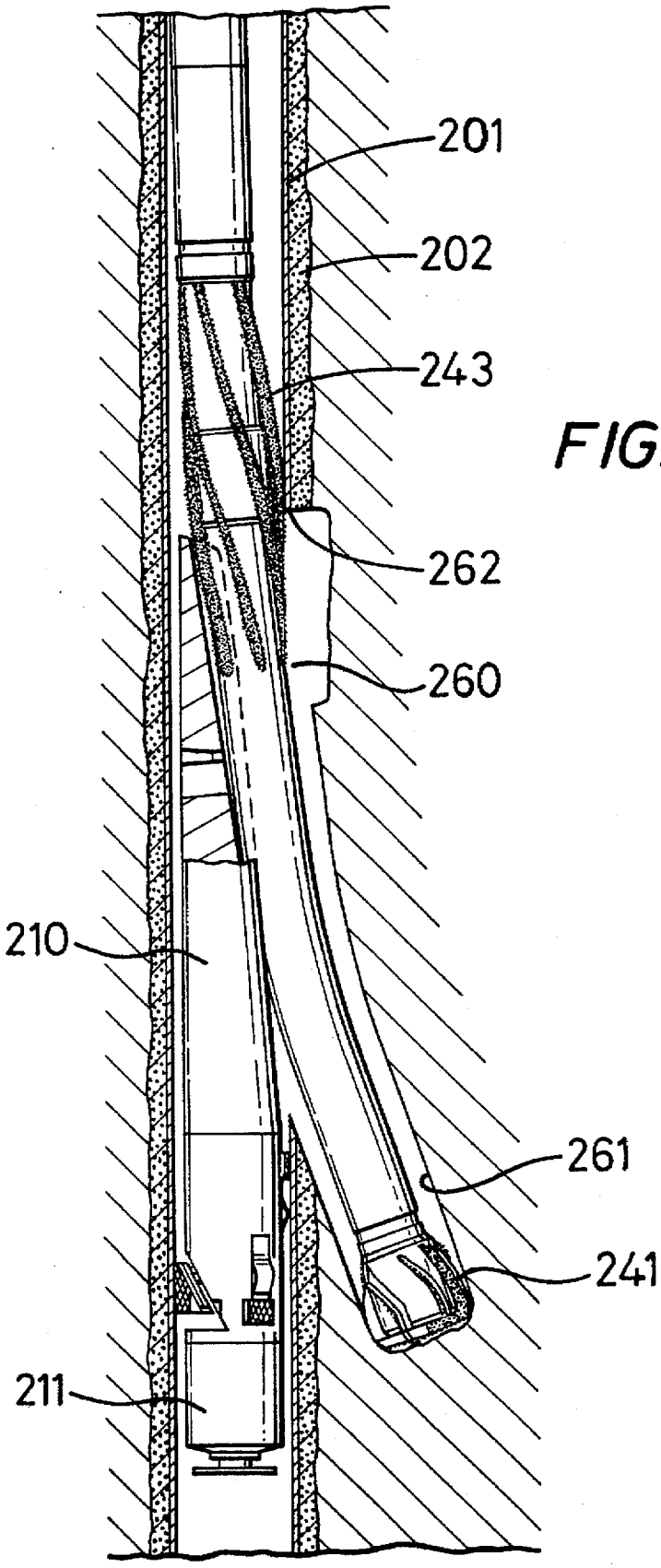
Figure 14:
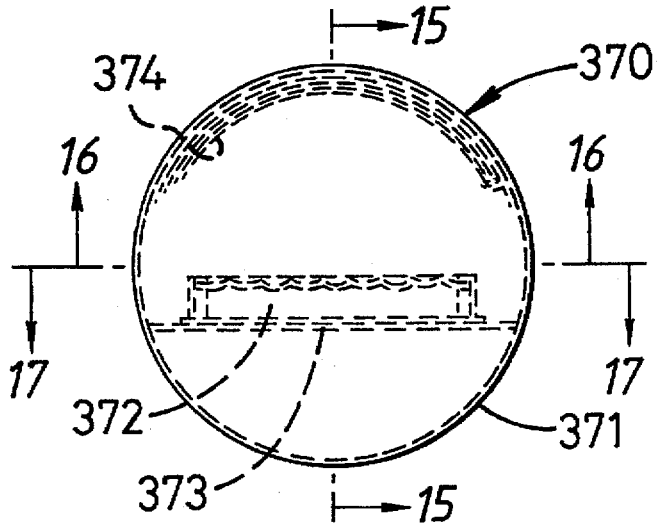
FIG. 14 is a top cross-section view of an explosive device useful in the system of FIG. 7.
Figure 15:
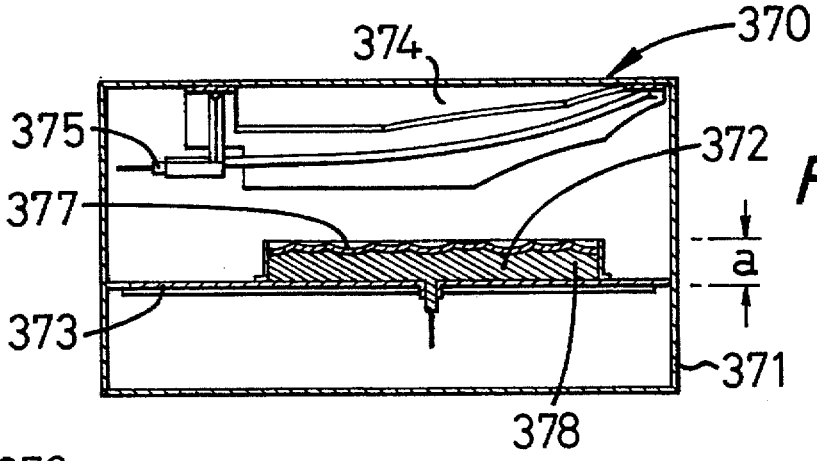
FIG. 15 is a cross-section view along line 15—15 of FIG. 14.
Figure 16:
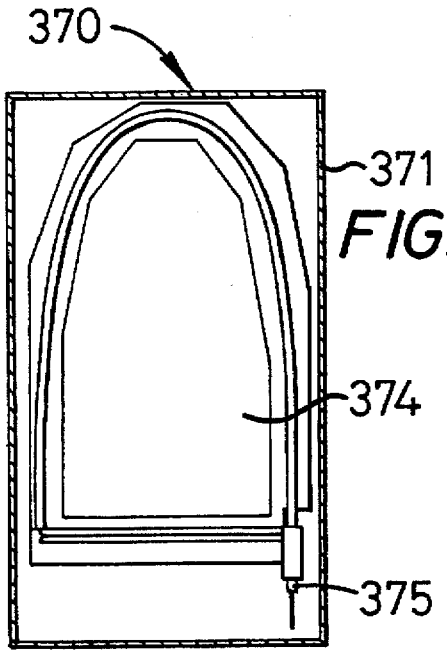
FIG. 16 is a cross-section view along line 16—16 of FIG. 14.
Figure 17:
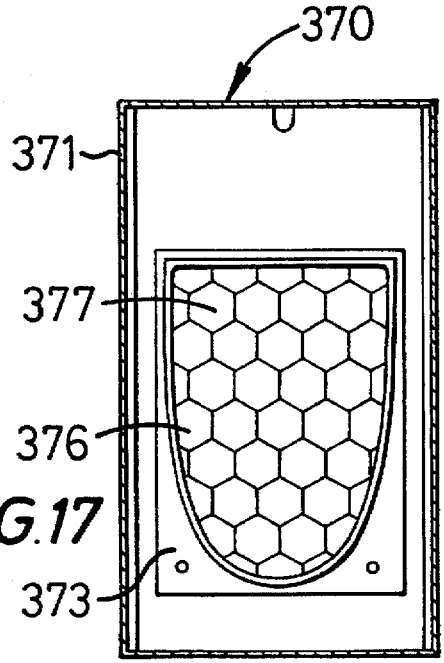
FIG. 17 is a cross-section view along line 17—17 of FIG. 14.

FIG. 13 illustrates the completed window 260 and a lateral bore 261 extending from the main wellbore 202. The watermelon mill 243 has begun to mill an edge 262 of the casing 201.

The system 200's firing mechanism is isolated from a hydrostatic head of pressure in an annulus between the firing head's exterior and the interior casing wall. Thus the firing head does not fire unless a ball is dropped as described above. The spring 332 guarantees that the firing pin does not strike the percussion initiator 333 unless and until the force of the spring is overcome. In one aspect the spring force is chosen so that it must be overcome by the hydrostatic pressure of fluid introduced above the firing piston. In one aspect the spring force is above the force of atmospheric pressure so unplanned firing does not occur at the surface. Fluid introduced on top of the firing piston 330 inhibits the introduction of debris, junk, etc. there and its accumulation there, i.e., material that could adversely affect the firing piston or inhibit or prevent firing; thus, preferably, i.e. a substantially static fluid regime is maintained within the tower and above the firing piston.

FIGS. 14–17 show an explosive device 370 for use as an explosive device 220 as described above (or for any other explosive device disclosed herein). It should be understood that any suitable explosive device may be used, including but not limited to: a jet charge, linear jet charge, explosively formed penetrator, multiple explosively formed penetrator, or any combination thereof. The device 370 has a housing 371 made, e.g. of plexiglass, fiberglass, plastic, or metal. A main explosive charge 372 secured to a plexiglass plate 373 is mounted in the housing 371. A linear jet explosive charge 374 with a booster detonator 375 is also mounted in the housing 371. The distance "a" in FIG. 15 in one embodiment is about 1.35 inches.

The main explosive charge 372 includes a liner 377 with a series of hexagonal discs 376 of explosive each about 0.090 inches thick. The discs 376 are, in certain embodiments, made of metal, e.g. zinc, aluminum, copper, brass, steel, stainless steel, or alloys thereof. A main explosive mass 378 is behind the discs 376. In one aspect this explosive mass is between about one half to five-eights of a kilogram of explosive, e.g. RDX, HMX, HNS, PYX, C4, or Cyclonite. In one aspect the liner 377 is about 8.64 inches high and 5.8 inches wide at its lower base.

Preferably the linear jet charge 374 is formed and configured to "cookie cut" the desired window shape in the casing and then the main charge 372 blows out the window preferably fragmenting the casing and driving it into the formation. By appropriate use of known timers and detonation cord, the linear jet charge can be exploded first followed by the main charge. Alternatively the two charges can be fired simultaneously.

At any location in the system 200 appropriate known explosive shock attenuation devices may be employed, including but not limited to materials having varying sound speeds, (e.g. a sandwich of rubber-plastic-rubber-plastic) and collapsing atmospheric chambers. Such devices may be placed above or below the charge or between the charge and any other item in the system, e.g. the whipstock, the extender, or the mill(s). The charge may be embedded in the concave at any point in the concave and, in one aspect, at the top of the concave. The charge alone may be introduced into a cased wellbore on a rope, cable, wireline, slickline or coiled tubing. Following positioning and orientation, the charge is fired to create a desired opening, ledge, lateral bore through casing and in one aspect at some distance into formation, or window in the casing. The rope, etc. is then removed and cutting, reaming, milling, drilling, and/or milling/drilling apparatus is introduced into the wellbore and moved to the location of the desired opening, etc. for further operations.

Figure 18A:
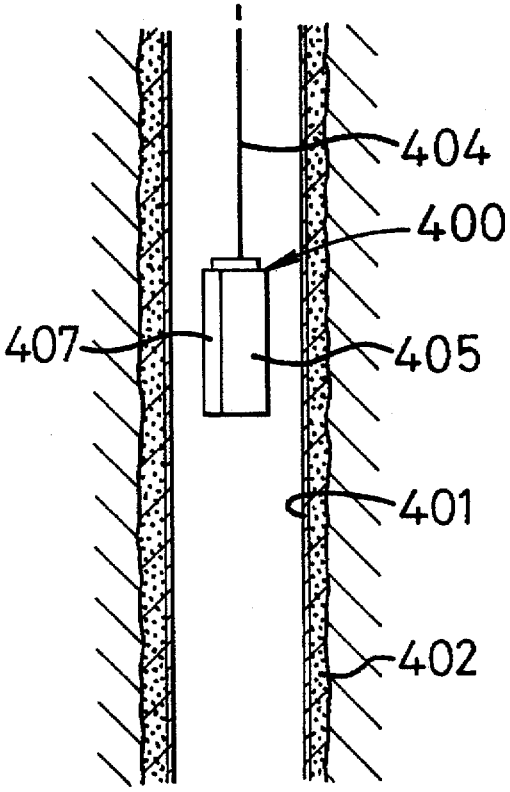
FIG. 18*a* is a schematic side view in cross-section of a system according to the present invention.
Figure 18B:
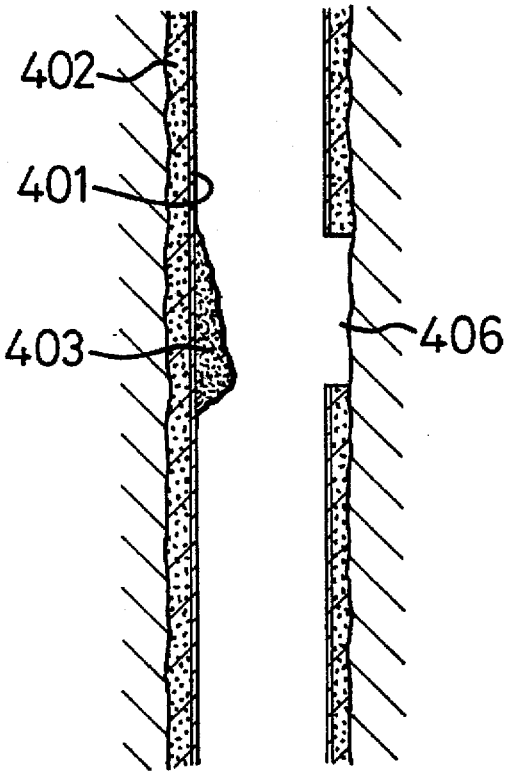
FIGS. 18*b* shows a diverter produced in the wellbore of FIG. 18*a* by the system of FIG. 18*a*.

FIGS. 18A and 18B disclose a system 400 for explosively forming an opening in a casing 401 in a wellbore 402 and for explosively forming a whipstock mill or bit or a diverter 403 on an interior casing wall. The system 400 apparatus is lowered (see FIG. 18A) into the wellbore 402 on a line 404. Known orienting apparatus assures correct orientation of the system. The explosive apparatus includes a main charge 405 for forming an opening 406 and a secondary charge with a body of material 407 for forming the diverter 403. In one aspect only one charge is used, but a body of material is used to form the diverter. As shown in FIG. 18B the explosion of the charge(s) has produced the diverter 403 explosively welded to or embedded in the casing 401 adjacent the opening 406. Instead of the mass of material, a formed diverter, wedge, or whipstock apparatus may be used which is explosively forced into or onto the casing 401.

FIGS. 19A–19D disclose a system 420 for explosively forming an opening 426 through a casing 421 in a wellbore 422 and for explosively forming a mill or bit diverter 423 in or on the interior casing wall. The system 420 is lowered on a line 424 to a desired position in the wellbore 422. A first charge 427 is fired to produce the opening 426. Then a second charge 428 with a mass of material included therein is lowered to a location adjacent the opening 426. Firing of the second charge 428 produces the diverter 423. Alternatively, the second charge 428 may be used to embed an already-formed diverter, wedge or whipstock in or on the casing wall.

Figure 20A:
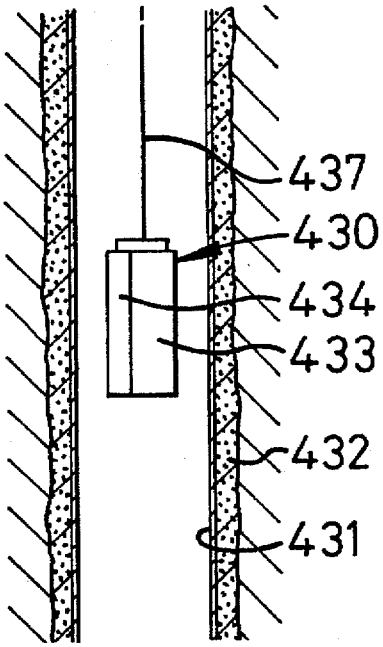
FIG. 20*a* is a schematic side view in cross-section of a system according to the present invention.
Figure 20B:
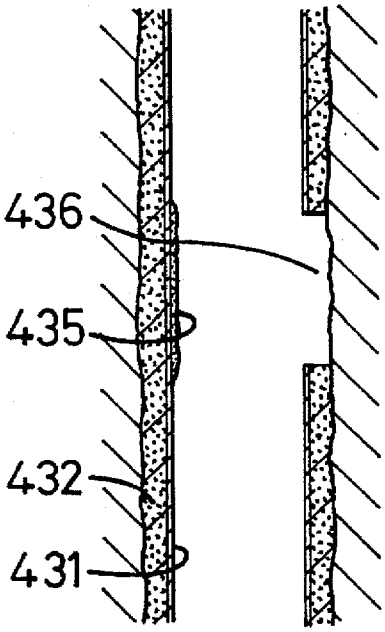
FIG. 20*b* shows a hardened area in the wellbore of FIG. 20*a* made by the system of FIG. 20*a*.
Figure 19D:
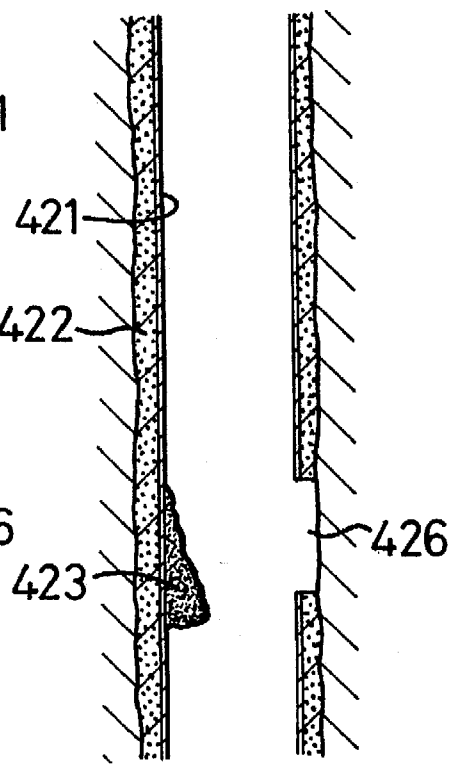
FIG. 19*d* shows a diverter in the wellbore of FIG. 19*a* made by the system of FIG. 19*a*.
Figure 19C:
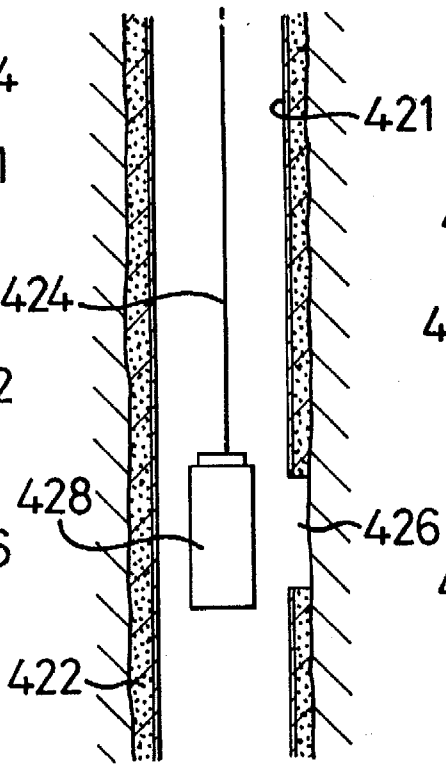
FIG. 19*b* and 19*c* are schematic side views in cross-section showing steps in a method of use of the system of FIG. 19*a*.
Figure 19B:
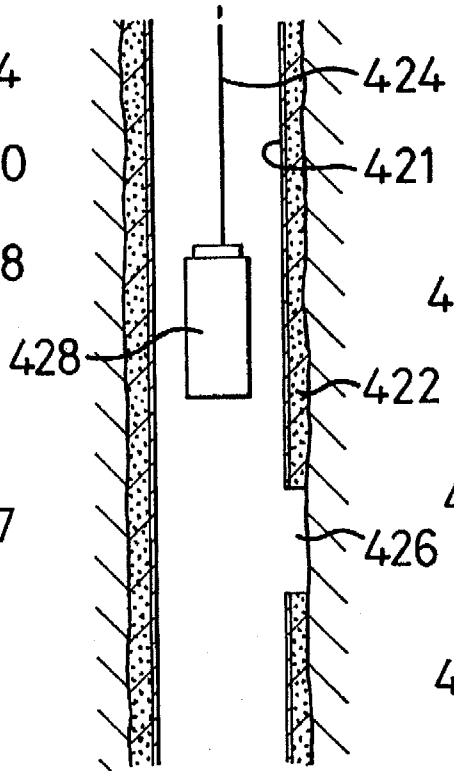
Figure 19A:
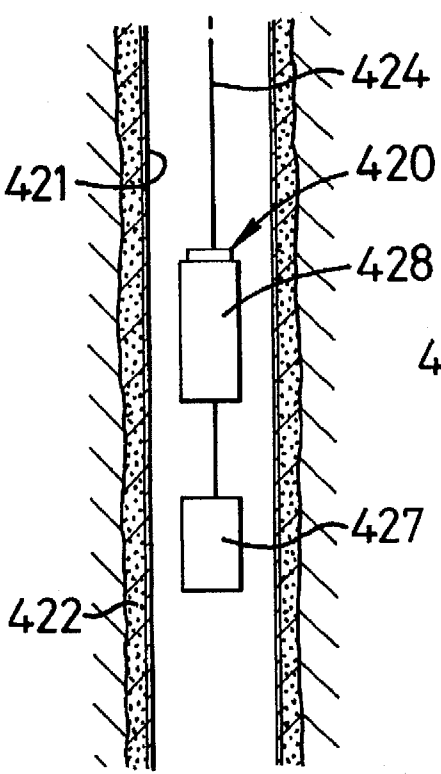
FIG. 19*a* is a schematic side view in cross-section of a system according to the present invention.
Figures 21A, 21B, 21C, 21D:
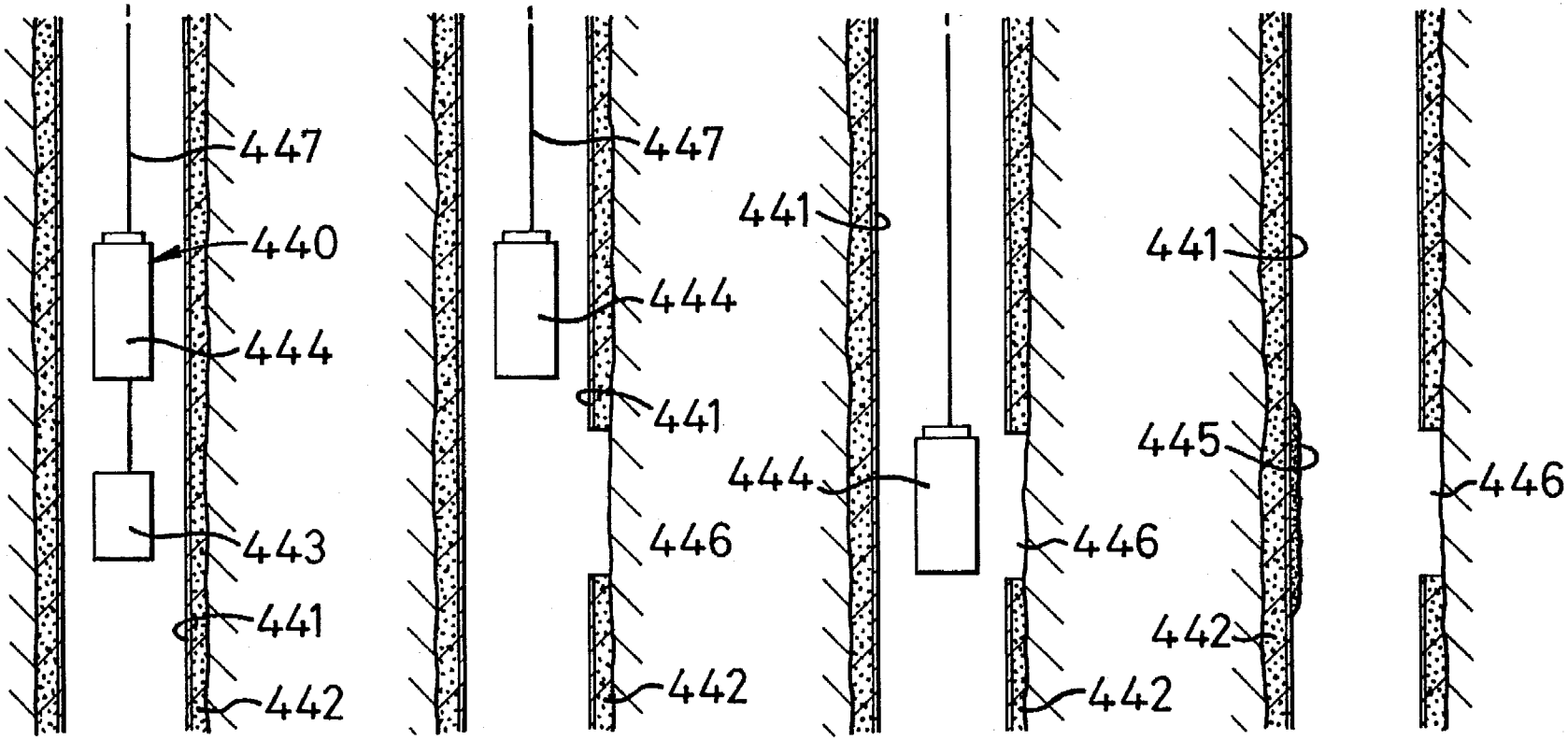
FIG. 21*a* is a schematic side view in cross-section of a system according to the present invention.
FIG. 21*d* shows a hardened area in the wellbore of FIG. 21*a* made by the system of FIG. 21*a*.

FIGS. 20A–20B show a system 430 lowered to a desired location in a casing 431 in a wellbore 432 on a line 437 and oriented as desired. The system 430 includes a main charge 433 fired to form an opening 436 in the casing 431. The system 430 has a secondary charge 434 which is fired to embed a mass of material 435 on the interior wall of the casing 431 adjacent the opening 436. Preferably this material is harder than material of which the casing is made so any cutting tool, mill or bit encountering the mass of material 435 will preferentially mill the casing 431. The material 435 may be one mass or a series of spaced-apart masses may be explosively placed on the casing wall, in one aspect spaced apart so that a mill always is in contact with one of the masses. Also the axial extent of the mass may be varied to coincide with the extent of the opening 436, to extend above it, and/or to extend below it, e.g. to facilitate milling of an entire window in embodiments in which the opening 436 is a partial window, opening, or ledge. As described below, the system 430 can be used to create an anchor member or support member in a tubular.

FIGS. 21A–21D show a system 440 lowered into a casing 441 in a wellbore 442 on a line 447. The system 440 has a main explosive charge 443 for explosively forming an opening 446 in the casing 441 after the system 440 has been oriented as desired in the wellbore 442; and a secondary explosive charge apparatus 444 with a mass of material included therein which is lowered adjacent the opening 446 (FIG. 21C) and fired to produce a layer of material 445 on the casing interior adjacent the opening 446. The layer of material 445 is preferably harder than material of which the casing 441 is made so a cutting tool, mill, or bit will preferentially act on the casing rather than the layer of material 445. The system 440 may be used to create an anchor member or support member in a tubular with a mass of material of sufficient size.

Regarding the systems of FIGS. 18A–22B, any suitable known orienting apparatus, anchor and/or anchor apparatus maybe used as part of the system to anchor the explosives (main charge and/or secondary charge) in place in a casing and so that desired orientation is achieved and maintained.

Figure 22A:
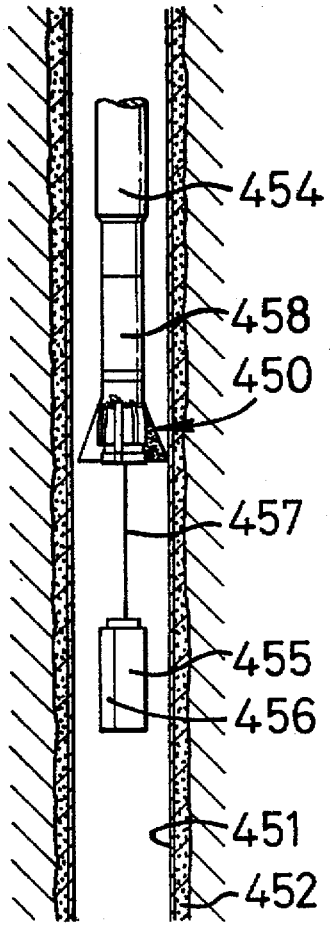
FIG. 22*a* is a schematic side view partially in cross-section of system according to the present invention.
Figure 22B:
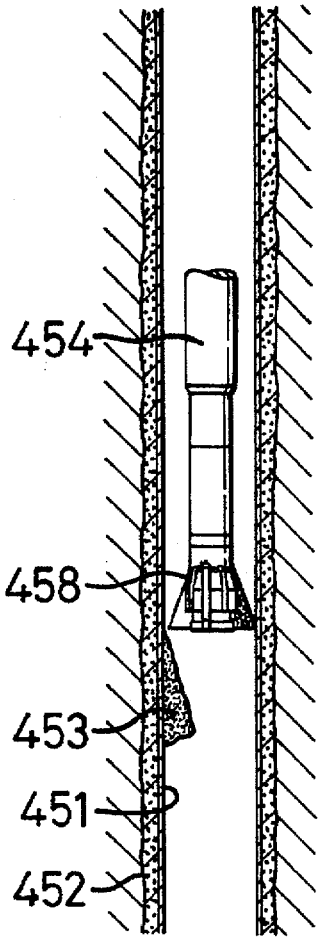
FIG. 22*b* shows a diverter made in the wellbore of FIG. 22*a* with the system of FIG. 22*a*.

FIGS. 22A and 22B shown a system 450 according to the present invention which has a main charge 455 suspended by a member or line 457 from a cutting tool 455 (cutter, reamer, bit, mill(s), or combination thereof) which is connected to a tubular string 454 which extends to the surface in casing 451 in wellbore 452. Alternatively a rope, line, wireline, slickline, or coil tubing may be used instead of the tubular string 454 (as is true for any line or tubular string for any explosive device disclosed herein). The system 450 is lowered in the wellbore 452 so that the main charge 455 is at a desired location and in a desired orientation. Firing the main charge 455 forces a mass of material 456 into or onto the interior wall of the casing 451 to form the diverter 453 (FIG. 22B). The cutting tool 455 is moved down to encounter the diverter 453 which forces the cutting tool against the casing 401. The cutting tool is rotated (e.g. by a downhole motor in the string 454 or by a rotary table) to form a desired opening in the casing 451. Known anchors and orienting devices may be used with this system.

Figure 23:
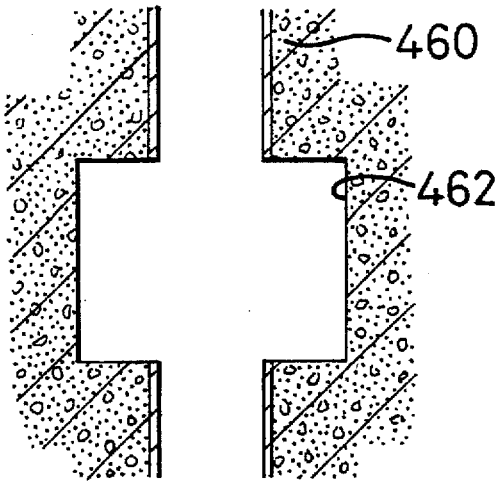
FIG. 23 is a schematic side view in cross-section of a wellbore underreamed with a system according to the present invention.

FIG. 23 shows schematically a wellbore 460 with an enlarged portion 462 formed by firing an explosive charge in the wellbore.

Figure 24:
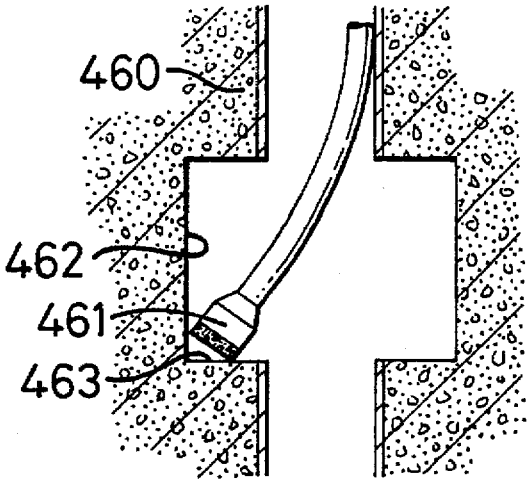
FIG. 24 shows a drilling system that has encountered a lower ledge of the underreamed portion of the wellbore of FIG. 23 and is commencing to drill a lateral wellbore for sidetracking operations.

FIG. 24 shows schematically a drilling system with a drill bit 461 which has encountered a ledge 463 formed by the explosive underreaming of the wellbore 460 and which is directed thereby away from the wellbore 460.

Figure 25:
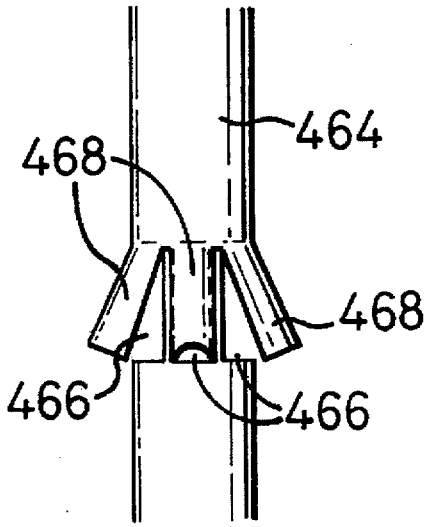
FIG. 25 is a side view of casing with openings formed by a method according to the present invention.

FIG. 25 shows a tubular 464, e.g. a piece of casing downhole in a wellbore, in which an explosive charge or charges have been fired to blow out multiple openings 466 in the casing without completely severing pieces of the casing 468. Since these casing pieces are not completely severed, they provide support for the formation preventing formation cave-in. Also, since each opening is at substantially the same level, multiple same-plane sidetracking is possible using the openings. Any desired number of openings (e.g., two, three, four) may be made at the same level in the casing.

Figure 26:
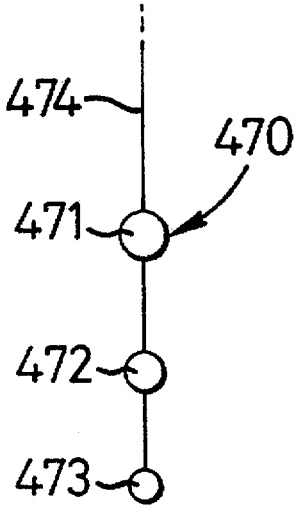
FIG. 26 is a schematics side view of a system according to the present invention.

FIG. 26 shows schematically a system 470 with a plurality of explosive charges 471, 472, 473 on a line 474. The system 470 may have two, four, five or more explosive charges. The system 470 is inserted into a wellbore for underreaming as in FIG. 22; for forming an opening, ledge, window, lateral bores, or hole in casing and/or in a formation (and for use with any system or method described herein using one or more explosive charges; for forming multiple openings (same plane or axially space apart), ledges, windows, lateral bores or holes in casing and/or in formation; for forming a single opening etc. by progressively firing a first charge, forming an initial opening, lowering a second charge adjacent the initial opening and firing it, to enlarge the opening, and so forth with a third or additional charges. The charges may be fired simultaneously or sequentially to form multiple openings, etc. The multiple openings can be oriented in different directions or on different sides of the casing, tubular, or wellbore.

Figure 27:
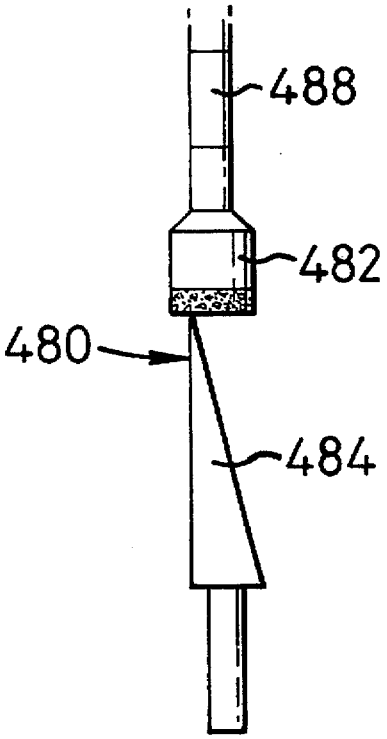
FIG. 27 is a schematic side view of a system according to the present invention.
Figure 28:
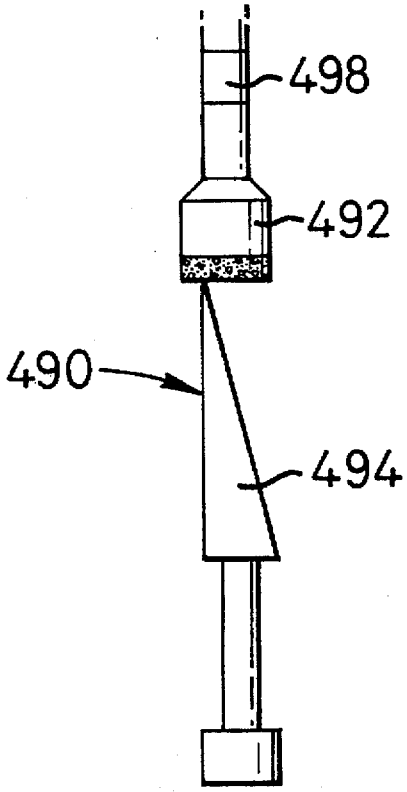
FIG. 28 is a schematic side view of a system according to the present invention.

FIG. 27 shows a system 480 according to the present invention with a mill (or reamer, bit or cutter) 482 releasably attached to a whipstock 484 beneath which and to which is secured an explosive charge (or charges) 486 either secured directly to the whipstock or on a line, rope, cable, etc. beneath and spaced apart from the whipstock. The mill 482 is secured to a tubular string (not shown) extending down into a cased wellbore (not shown). A firing head 488 is associated with the mill 482 and interconnected with the charge 486 (see e.g. the firing head and interconnection in FIG. 8). The charge 486 is fired creating an opening (defined herein for all embodiments as a ledge, hole, lateral bore, or window) in the wellbore casing. The mill 482 and whipstock 484 are then lowered to the location of the opening and the mill 482 may be activated to further mill out a window at that location.

A system 490 as in FIG. 27 is like the system 480 but an anchor 499 is used below a charge 496. The anchor 499 is set at a desired location in the wellbore; the charge is fired creating an opening; the whipstock 494 is lowered to mate with the anchor 499 so it is maintained in place adjacent the opening; the mill 492 is released from the whipstock 494 and mills a window (or part thereof) at the opening. A firing head 498 is similar to the firing head 488 of FIG. 26. Alternatively, the charge can be placed between the mill 492 and the whipstock 494 and the anchor is set after an opening has been explosively made.

In any system described herein in which a whipstock or other member is to be anchored in a casing, tubular, or wellbore, or in which such an item is to be maintained in position therein, an explosive charge apparatus may be used to embed a mass of metal in or on an interior tubular or wellbore wall so that the mass serves as a member to support a whipstock or other item. The mass can close off the bore through the tubular partially (with fluid flow possible therethrough or therearound) or completely and it can be of any suitable metal; easily drillable or millable or drillable or millable with difficulty; e.g. zinc, aluminum, copper, steel, tungsten carbide, stainless steel, armor material, or brass. Any system described above for embedding a mass of material in or on a tubular wall, with a mass of sufficient size, can be used to create such an anchor member.

Figure 29A:
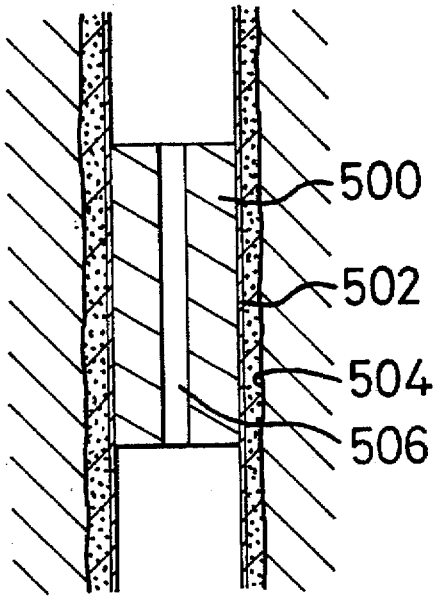
FIG. 29*a* is a side view in cross-section of a wellbore support formed by a system according to the present invention.
Figure 29B:
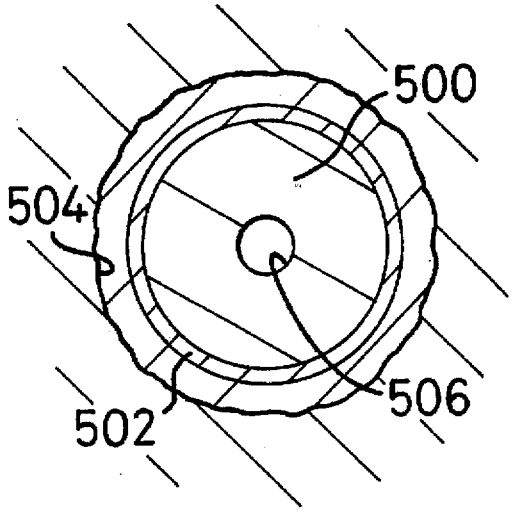
FIG. 29*b* is a cross-section view of the support of FIG. 29*a*.

FIGS. 29*a* and 29*b* show an explosively formed support or anchor mass 500 in a casing 502 in a wellbore 504. The anchor mass has been formed so there is a fluid flow channel 506 therethrough. The anchor mass 500 is suitable for supporting an item above it in the wellbore, e.g., but not limited to, a whipstock. Although the anchor mass is shown as encircling the entire circumference of the casing, it is within the scope of this invention for it to cover only a portion of the circumference.

Figure 30A:
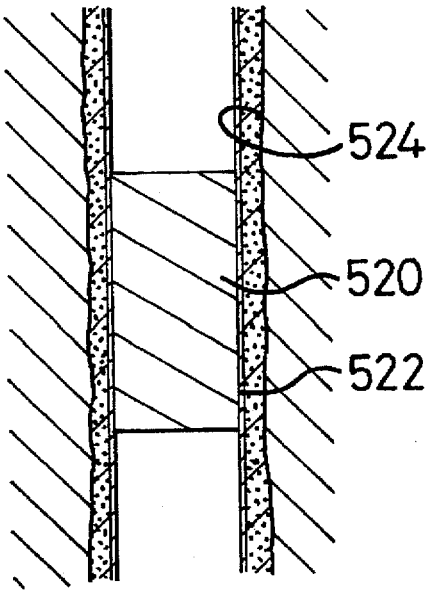
FIG. 30*a* is a side view in cross-section of a wellbore support formed by a system according to the present invention.
Figure 30B:
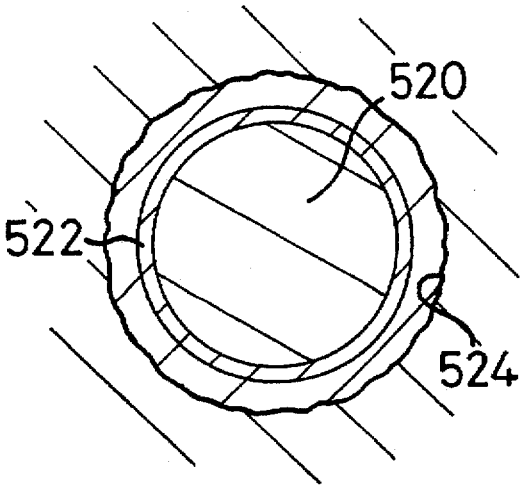
FIG. 30*b* is a cross-section view of the support of FIG. 30*a*.

FIGS. 30*a* and 30*b* show an explosively formed support or anchor mass 520 which completely shuts off fluid flow through a casing 522 in a wellbore 524. The anchor masses of FIGS. 29*a* and 30*a* are formed by exploding an explosive device or devices with a sufficient amount of metal to form the desired mass. The explosion explosively welds the masses to the casing's interior wall and/or embeds part of the metal in the casing.

Filed on even date herewith and co-owned with this application is the U.S. application attached hereto as an Appendix and made a part hereof for all purposes entitled "Wellbore Single-Trip Milling."

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. Apparatus for making a window in a tubular member, the apparatus comprising a cutter diversion device disposable in a tubular member along which a cutter is movable so that the cutter is directed against the tubular member for cutting by the cutter to form a window in the tubular member for wellbore sidetracking operations, and explosive apparatus connected to and below the cutter diversion device for explosively making an initial opening in the tubular member as an initial part of the window.

2. The apparatus of claim 1 wherein the tubular member is a piece of casing in a cased wellbore.

3. The apparatus of claim 1 further comprising the cutter.

4. The apparatus of claim 3 wherein the cutter is a mill for milling an opening in the tubular member.

5. The apparatus of claim 3 wherein the cutter is a wellbore drilling apparatus.

6. The apparatus of claim 3 further comprising extender apparatus connecting the cutter to and spacing it apart from the cutter diversion device.

7. The apparatus of claim 1 wherein the cutter diversion device is a whipstock.

8. The apparatus of claim 1 further comprising anchor apparatus connected to the cutter diversion device for anchoring the cutter diversion device in a wellbore.

9. The apparatus of claim 8 wherein the anchor apparatus is connected to and below the explosive apparatus.

10. The apparatus of claim 1 wherein the explosive apparatus further comprises at least two explosive charges comprising at least a first explosive charge for exploding adjacent the tubular member to initially impact the tubular member at a location of the window, and a second explosive charge for exploding at the location of the window.

11. The apparatus of claim 10 further comprising sequencing means for sequentially detonating the at least two explosive charges so that the first explosive charge cuts a desired window shape in the tubular member and the second explosive charge blows out the window.

12. The apparatus of claim 3 further comprising a firing head connected to the cutter for detonating the explosive apparatus.

13. The apparatus of claim 12 wherein the cutter is a wellbore milling apparatus and the firing head is secured to the wellbore milling apparatus.

14. The apparatus of claim 13 wherein detonation cord selectively detonatable by the firing head extends from the firing head, through the wellbore milling apparatus, to the explosive apparatus.

15. The apparatus of claim 12 further comprising firing head activation means for selectively firing the firing head.

16. The apparatus of claim 15 wherein the tubular member is in a wellbore in the earth and the firing head activation means is operable by fluid under pressure pumped down the wellbore from a surface of the earth.

17. The apparatus of claim 16 further comprising pressure isolation apparatus for isolating the firing head from effects of fluid pressure other than the fluid under pressure pumped down the wellbore.

18. The apparatus of claim 17 wherein the pressure isolation apparatus isolates the firing head from atmospheric pressure.

19. Apparatus for making a window in a tubular member, the apparatus comprising a cutter for cutting the tubular member, a cutter diversion device disposable in a tubular member along which the cutter is movable so that the cutter is directed against the tubular member for cutting by the cutter to form a window in the tubular member for wellbore sidetracking operations, the tubular member in a wellbore in the earth, explosive apparatus connected to and below the cutter diversion device for explosively making an initial opening in the tubular member as an initial part of the window, extender apparatus connecting the cutter to and spacing it apart from the cutter diversion device, anchor apparatus connected to the cutter diversion device for anchoring the cutter diversion device in a wellbore, a firing head connected to the cutter for detonating the explosive apparatus, firing head activation means for selectively firing the firing head, the firing head activation means operable by fluid under pressure pumped down the wellbore from a surface of the earth, and pressure isolation apparatus for isolating the firing head from effects of fluid pressure other than the fluid under pressure pumped down the wellbore.

20. Apparatus for making a window in a tubular member in a wellbore, the window for wellbore sidetracking operations, the apparatus comprising a first explosive device for explosively forming a diversion device on an interior surface of the tubular member, the diversion device for diverting a wellbore cutter, and a second explosive device connected to the first explosive device for explosively making an opening through the tubular member to facilitate formation of the window by the wellbore cutter.

* * * * *